US005367602A

United States Patent [19]

Stewart

[11] Patent Number: 5,367,602

[45] Date of Patent: Nov. 22, 1994

[54] CONTROL APPARATUS AND METHOD FOR ELECTRIC HEATER WITH EXTERNAL HEAT SOURCE

[75] Inventor: Jeffrey L. Stewart, Carrollton, Tex.

[73] Assignee: Lennox Industries Inc., Richardson, Tex.

[21] Appl. No.: 140,214

[22] Filed: Oct. 21, 1993

[51] Int. Cl.[5] ..... F24H 1/00

[52] U.S. Cl. ..... 392/308; 165/29; 237/2 B

[58] Field of Search ..... 392/308, 451–454, 392/463, 464; 219/509; 165/29; 237/2 B, 8 A; 126/362

[56] References Cited

U.S. PATENT DOCUMENTS

| | | | |
|---|---|---|---|
| 4,498,622 | 2/1985 | Harnish | 237/2 B |
| 4,540,874 | 9/1985 | Shaffer, Jr. et al. | 392/308 |
| 4,543,468 | 9/1985 | Shaffer, Jr. et al | 392/308 |
| 5,255,338 | 10/1993 | Robinson, Jr. et al. | 392/451 |

FOREIGN PATENT DOCUMENTS

| | | | |
|---|---|---|---|
| 2519415 | 7/1983 | France | 392/308 |
| 59-74450 | 4/1984 | Japan | 392/308 |
| 60-164151 | 8/1985 | Japan . | |
| 60-164158 | 8/1985 | Japan . | |
| 1-230959 | 9/1989 | Japan . | |
| 2-217750 | 8/1990 | Japan . | |

*Primary Examiner*—Bruce A. Reynolds
*Assistant Examiner*—John A. Jeffery
*Attorney, Agent, or Firm*—W. Kirk McCord

[57] ABSTRACT

A water heating system, including both a conventional water heater and an external heat source such as a heat pump, is controlled in accordance with the present invention. The water heater includes a water storage tank, an electrically resistive heating element located in the tank, and a tank-mounted thermostat which closes in response to a demand for water heating to allow electric current flow to the heating element and which opens when the demand for water heating has been satisfied, to interrupt the electric current flow to the heating element. The external heat pump includes a water pump for circulating the water between the storage tank and the heat pump, whereby water is heated by the heat pump and returned to the tank. A current sensor is provided for sensing the flow of electric current to the heating element and a temperature sensor is located external to the water storage tank for sensing the temperature of the water entering the heat pump before the water is heated thereby. When the current sensor senses a flow of electric current to the heating element, the current flow is interrupted so as to disable the heating element and the heat pump is enabled to provide the primary source of heating. The heat pump is operated until the temperature of the incoming water exceeds a predetermined set temperature.

19 Claims, 3 Drawing Sheets

CONTROL APPARATUS AND METHOD FOR ELECTRIC HEATER WITH EXTERNAL HEAT SOURCE

TECHNICAL FIELD

This invention relates generally to water heating and, in particular, to an improved apparatus and method for controlling a water heating system.

BACKGROUND ART

According to statistics promulgated by the Energy Information Administration in 1990, there were approximately 35,000,000 residential water heaters operated by electricity out of a total of approximately 94,000,000 residential water heaters. The high cost of electricity relative to fuels such as natural gas is well known. On an operating cost basis, the cost per Btu of delivered water heating for electrical resistance water heaters is two to two and one-half times that: of natural gas-fired water heaters. The concern for reducing energy consumption and conserving natural resources has given rise to a need for cost-effective substitutes for electrical resistance heating of water. Various substitutes for electrical resistance water heating that operate on electricity are known in the water heating industry. These substitutes include solar-assisted water heating systems, desuperheater water heating systems, and heat pump water heaters.

One example of a heat pump water heater is described in U.S. Pat. No. 4,540,874. The heat pump is located external to a conventional water heater having an electrically resistive heating element. A control system is provided for deactivating the heating element and activating the heat pump in response to an initial surge of electric current to the heating element when the contacts of a tank-mounted thermostat are closed, indicating a demand for water heating. Under normal circumstances, the heat pump is operated until the thermostat contacts open, indicating that the demand for water heating has been satisfied. If there is an abnormal condition detected in the heat pump, the control system deactivates the heat pump and activates the electrically resistive heating element until the demand for water heating has been satisfied.

One disadvantage of this type of system is that it utilizes an existing tank-mounted thermostat to control the heat pump. Such a thermostat is designed to switch a relatively high electric current (e.g., greater than 15 amps) and, therefore, may not be able to reliably switch a relatively low electric current (e.g., less than one amp) control circuit. Further, the tank-mounted thermostat may be of unknown specification and wear (i.e., time in operation). Replacement of the tank-mounted thermostat with a thermostat having a different specification (e.g., set points) may be necessitated.

Yet another disadvantage of using a tank-mounted thermostat to control an external heat source such as a heat pump is that as the water in the tank is heated to a certain temperature (e.g., 130° F.), the condensing temperature of the refrigerant in the heat pump must typically be 20° F. higher (e.g., 150° F.) in order to further heat the water. If R22 refrigerant is used, the compressor discharge pressure must reach approximately 400 psi to achieve the 150° F. refrigerant temperature, which exceeds recommended operating parameters for a heat pump using this type of refrigerant. If the tank-mounted thermostat is set at higher than 130° F., the heat pump will not be able to deliver the required water heating because it would be operating well above recommended limits. Although the system described in U.S. Pat. No. 4,540,874 provides for detection of an abnormal condition in the heat pump and switching to the electrically resistive heating element to complete the water heating, it is not desirable to operate the heat pump until the point that an abnormal condition occurs.

DISCLOSURE OF INVENTION

In accordance with the present invention, apparatus is provided for controlling a water heating system. The water heating system includes a water storage tank, an electrically resistive heating element located in the tank, and a tank-mounted thermostat, as well as a heat source external to the tank. The thermostat closes in response to a demand for water heating to allow electric current to flow to the heating element and opens when the demand for water heating has been satisfied to interrupt the electric current flow to the heating element. The external heat source includes means for circulating water between the tank and the external heat source, whereby water is heated by the external heat source and returned to the tank. The apparatus is comprised of electric current sensing means for sensing electric current flow to the heating element and for providing a first electrical signal indicative thereof; temperature sensing means external to the tank for sensihg the temperature of the water at a selected location external to the tank and for providing a second electrical signal indicative thereof; and control means for interrupting the electric current flow to the heating element in response to the first electrical signal to deactivate the heating element and for activating the external heat source to heat water circulated between the tank and the external heat source. The control means is responsive to the second electrical signal for deactivating the external heat source when the second electrical signal indicates that the water temperature has exceeded a predetermined temperature.

In accordance with one feature of the invention, the control means ignores the first electrical signal in response to the second electrical signal indicating that the water temperature has exceeded the predetermined temperature, to allow electric current flow to the heating element until a predetermined condition has been satisfied. In one embodiment, the predetermined condition is satisfied when a predetermined period has elapsed since the deactivation of the external heat source. User-settable delay means is provided for setting the predetermined period. The control means is responsive to the predetermined period set by the user for ignoring the first electrical signal for the predetermined period, thereby allowing electric current flow to the heating element if the thermostat is still closed (which indicates that the demand for water heating has not been satisfied), until the predetermined period has elapsed.

In the preferred embodiment, the external heat source includes a heat pump. The temperature sensing means is located for sensing the temperature of the water entering the heat pump before the water is heated thereby. The water to be heated by the heat pump is removed from a bottom part of the tank, or taken directly from a cold water supply line, and transported to the heat pump via an incoming water line. After the water is heated, it is returned to the tank via an outgoing water line. The heat pump is deactivated when the temperature of the water entering the heat pump exceeds the predetermined temperature. The predetermined temperature is preferably set by a user.

BEST MODE FOR CARRYING OUT THE INVENTION

The best mode for carrying out the invention will be described with reference to the accompanying drawings. The drawings are not necessarily to scale and in some instances proportions may have been exaggerated in order to more clearly depict certain features of the invention. Like parts are marked with the same respective reference numbers throughout the drawings.

Figure 1:
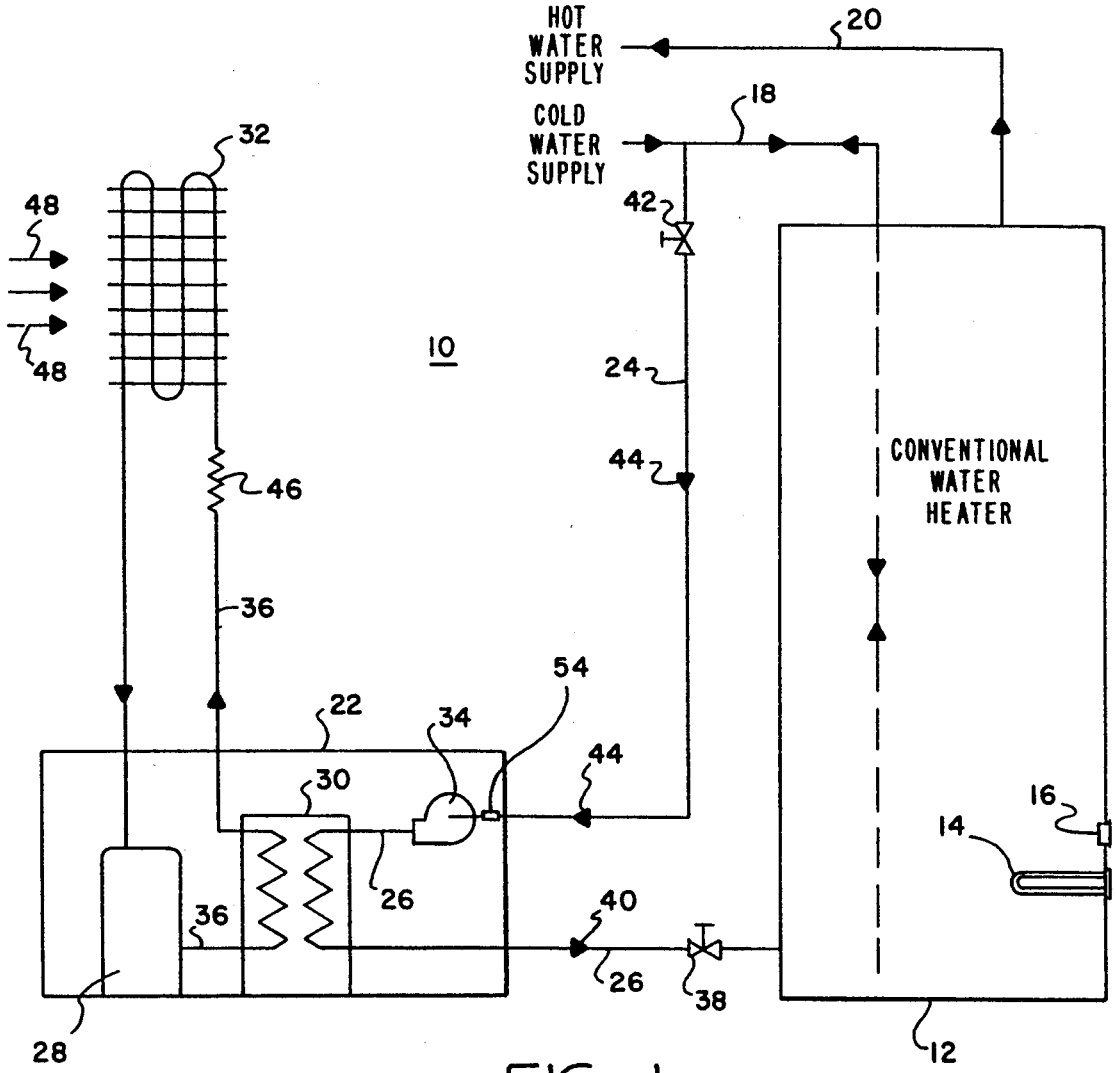
FIG. 1 is a schematic of a water heating system, including a conventional water heater and a heat pump.

Referring to FIG. 1, a water heating system 10 includes a conventional hot water storage tank 12, an electrically resistive heating element located in tank 12, and a user-settable thermostat 16 mounted with tank 12 for monitoring the temperature of the water stored in tank 12. Thermostat 16 operates in the conventional fashion (i.e., the thermostat contacts close in response to a demand for water heating and open when the demand for water heating has been satisfied). Cold and hot water supply lines 18 and 20, respectively, are connected to tank 12. The water to be heated is supplied to tank 12 via line 18 and heated water is removed from tank 12 via line 20.

Water heating system 10 further includes an external heat source such as a heat pump 22. Heat pump 22 is operatively connected with tank 12 by means of water lines 24 and 26. Heat pump 22 includes a compressor 28, refrigerant-to-water heat exchanger 30 and an evaporator coil 32 located in the return air stream of a conventional space conditioning system 49. Space conditioning system 49 is systemically separate from heat pump 22. A water pump 34 is operatively associated with heat pump 22.

When heat pump 22 is operated, relatively cold water from the bottom part of tank 12 or from the incoming cold water supply is drawn through lines 18 and 24 by pump 34 into heat exchanger 30. Compressor 28 discharges hot vapor refrigerant through discharge line 36 into heat exchanger 30. The hot refrigerant gives up heat to the water in heat exchanger 30 and the heated water is returned to tank 12 through discharge line 26. Line 24 is on the suction side of pump 34 and line 26 is on the discharge side thereof. Water flow is in the direction of Arrows 44 and 40. A manual valve 38 is located in line 26 and a manual valve 42 is located in line 24. Valves 38 and 42 allow servicing of heat pump 22.

A capillary tube 46 is located in line 36 between heat exchanger 30 and evaporator 32. Capillary tube 46 functions as an expansion device for reducing the pressure of the refrigerant in line 36. Alternatively, another type of expansion device, such as a thermal expansion valve, may be used. When heat pump 22 is operated, an air blower 47 associated with space conditioning system 49 is also operated to provide an air flow across evaporator 32, as indicated by Arrows 48. Arrows 48 represent the return air stream of space conditioning system 49 (i.e., the suction side of blower 47). An evaporator 51 associated with space conditioning system 49 is located on the discharge side of blower 47 for cooling the supply air of space conditioning system 49. The supply air is represented by Arrows 53. The cooling by-product of heat pump 22 cools the return air stream, thereby precooling the supply air before the supply air is cooled by evaporator 51. This type of heat pump water heater is described in greater detail in co-pending application Ser. No. 08/020,166, filed Feb. 19, 1993 and entitled "Ancillary Heat Pump Apparatus for Producing Domestic Hot Water", which is hereby incorporated by reference herein.

Figure 2:
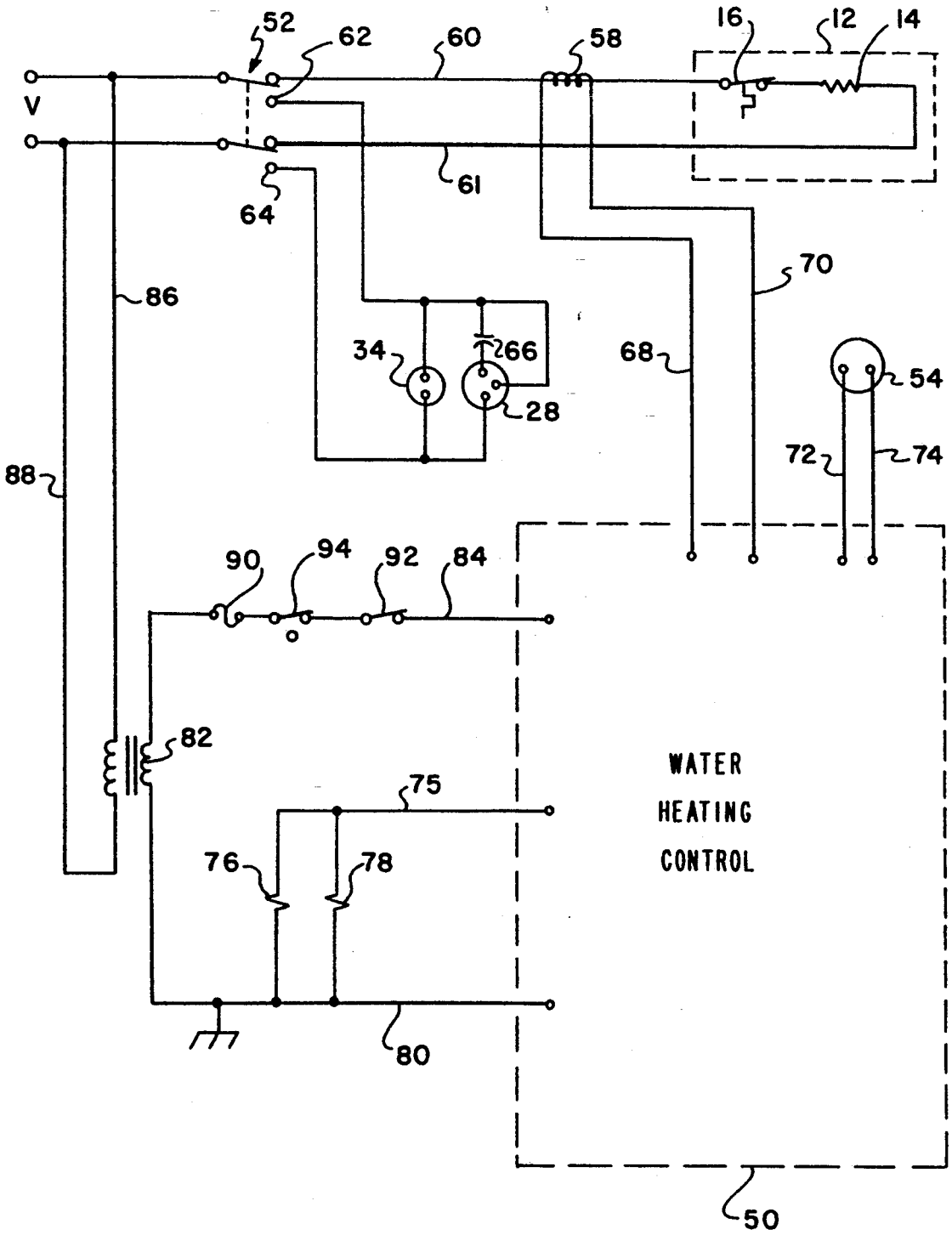
FIG. 2 is an electrical schematic of water heating control apparatus, according to the present invention.

Referring also to FIG. 2, apparatus 50 is provided for controlling water heating system 10 in accordance with the present invention. Thermostat 16 is in series between an electrical power supply, which applies an AC voltage V (e.g., 220 volts) between electrical conductors 60 and 61, and heating element 14. A double pole, double throw relay switch 52 is normally in the position shown in FIG. 2 for permitting electric current to flow to heating element 14 when thermostat 16 is closed.

In accordance with the present invention, a temperature sensor 54 (which may be a thermistor) is positioned for sensing the temperature of the water entering heat pump 22 through line 24 (FIG. 1) and for providing an electrical signal indicative of the measured temperature. The water temperature measured by sensor 54 should be approximately the same as the temperature of the water in the bottom part of tank 12 because the water entering heat pump 22 is drawn from the bottom of tank 12. In accordance with the present invention, this external temperature sensor 54 is used to control the operation of heat pump 22 instead of the tank-mounted thermostat 16, as will be described in greater detail hereinafter.

Figure 3:
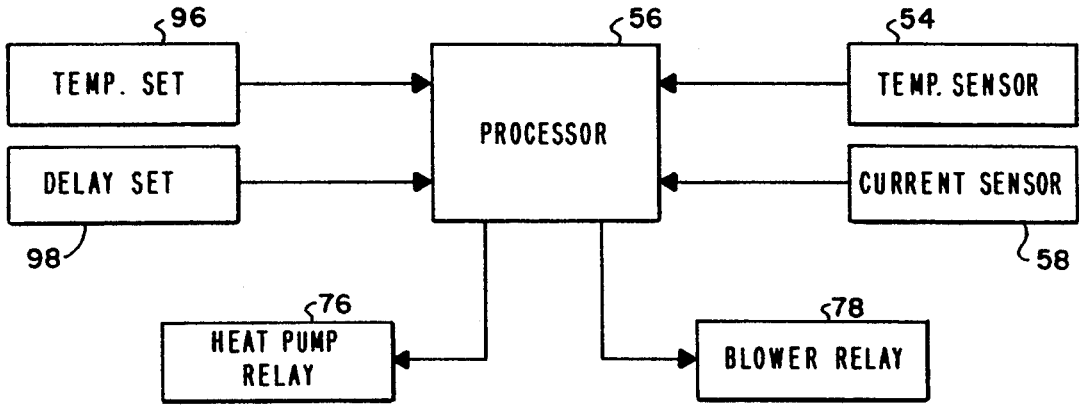
FIG. 3 is a block diagram of the water heating control apparatus of FIG. 2.

Referring also to FIG. 3, control apparatus 50 includes a processor 56, which may be a microprocessor of the 68HCO5 type, manufactured and sold by Motorola, Inc. Processor 56 is responsive to the water temperature measured by sensor 54 and to the electric current measured by current sensor 58. Sensor 58 is preferably a current transformer, which is positioned for detecting a flow of electric current in electrical conductor 60, which occurs when thermostat 16 is closed (i.e., a demand for water heating is indicated).

Processor 56 is responsive to an electrical signal generated by sensor 58 indicating current flow to heating element 14 for interrupting the flow of electric current to heating element 14 to disable heating element 14 and for activating heat pump 22 to perform the water heating function. The flow of electric current to heating element 14 is interrupted by switching the position of relay 52 so that relay 52 contacts terminals 62 and 64, thereby providing electrical power to water pump 34 and compressor 28. Compressor 28 has a run capacitor 66 associated therewith. Current sensor 58 transmits an electrical signal indicating current flow through conductor 60 through processor 56 via electrical conductors 68 and 70. Temperature sensor 54 transmits an electrical signal indicative of the temperature of the water entering heat pump 22 to processor 56 via electrical conductors 72 and 74.

Processor 56 switches The position of relay 52 by generating a control signal on electrical conductor 75 to energize a coil 76 associated with relay 52. The control signal on conductor 75 simultaneously energizes a coil 78 associated 20 with the blower of the systemically separate space conditioning system so that the blower will provide air flow across evaporator 32, as previously described. Therefore, processor 56 is operable to interrupt the current flow to heating element 14 and activate water pump 34, compressor 28 and the space conditioning system blower substantially simultaneously via the control signal on conductor 75. Conductor 80 is a common or ground conductor.

A step-down transformer 82 is provided for reducing the line voltage (e.g., 220 volts AC) to a substantially lower voltage (e.g., 24 volts AC). The stepped-down AC voltage is converted to DC voltage by a rectifier or the like (not shown) to provide suitable DC power for processor 56. Rectifier circuitry is preferably included in control apparatus 50. The stepped-down AC voltage is supplied to control apparatus 50 via electrical conductor 84. The line voltage is supplied to transformer 82 via conductors 86 and 88, which are tapped off conductors 60 and 61, respectively. A fuse 90 is positioned in conductor 84 to prevent excess voltage from being supplied to control apparatus 50. A toggle switch 92 is provided as an on/off switch for heat pump 22 and a high pressure cutout switch 94 is provided for deactivating heat pump 22 in the event of abnormally high refrigerant pressure (e.g., greater than 400 psi) in compressor discharge line 36.

Control apparatus 50 further includes a manually operable device 96, which operates in conjunction with sensor 54 for setting the desired temperature of the water to be heated. The temperature setting device 96 may be a potentiometer or other device with a manually operable dial by which one can set the desired water temperature. When sensor 54 indicates that the incoming water temperature has exceeded the set temperature, control apparatus 50 deactivates heat pump 22 by discontinuing the control signal applied to conductor 75, which de-energizes coils 76 and 78 and toggles relay 52 back to the position shown in FIG. 2, thereby deactivating heat pump 22 and blower 47.

Control apparatus 50 preferably also includes a manually operable device 98 for setting a time delay. Device 98 may include a plurality of pin connections and a jumper which is connectable between any selected combination of pins, the selected combination determining the time delay. For example, pin combinations may be selected corresponding to respective time delays of 5, 10, 15, 20 and 25 minutes. Processor 56 is responsive to the set time delay for ignoring the electrical signal from current sensor 58 for the set period of time after heat pump 22 has been deactivated, thereby allowing electric current to flow to heating element 14 if thermostat 16 is still closed. This situation should only occur if thermostat 16 is set at a higher temperature than the temperature set by means of device 96. Control apparatus 50 therefore allows the electrically resistive heating element 14 to act as a booster for heat pump 22 if heat pump 22 is unable to heat the water to the required temperature. Heat pump 22 is used to satisfy the water heating demand to the extent feasible and heating element 14 is used only when necessary to "top off" the temperature of the water in tank 12.

Figure 4:
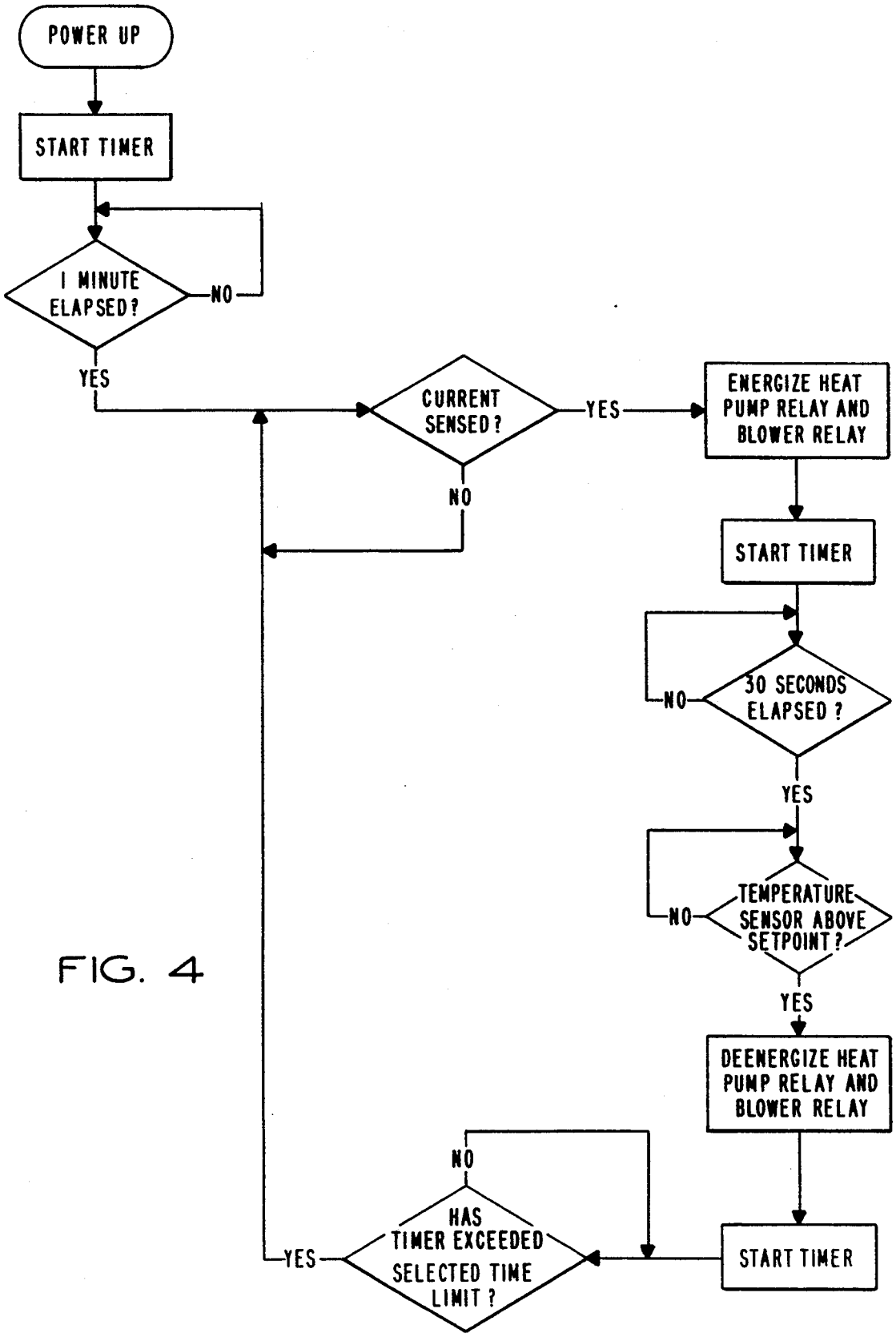
FIG. 4 is a flow chart of the water heating control routine, according to the present invention.

The operation of control apparatus 50 will be better understood with reference to FIGS. 2 and 4. When the system is powered-up from a "power off" condition, heating element 14 is enabled and the control routine will remain in a "power up" condition for a first predetermined period (e.g., one minute). After the first predetermined period has elapsed, current sensor 58 is operable for sensing electric current flow to heating element 14. When electric current flow is detected by sensor 58, which indicates a demand for water heating, coils 76 and 78 are energized thereby activating heat pump 22 and blower 47 (FIG. 1) and disabling heating element 14. For a second predetermined period (e.g., 30 seconds), commencing at the time heating element 14 is disabled, temperature sensor 54 monitors the temperature of water entering heat pump 22. If at the end of the second predetermined period the incoming water temperature exceeds the set temperature, coils 76 and 78 are de-energized, thereby deactivating heat pump 22 and blower 47. If at the end of the second predetermined period the 20 incoming water temperature does not exceed the set temperature, the operation of heat pump 22 and blower 47 will continue until the temperature of the water entering heat pump 22 reaches the set temperature, whereupon coils 76 and 78 are de-energized, thereby deactivating heat pump 22 and blower 47 and enabling heat element 14.

For a third predetermined period (e.g., 5 to 25 minutes), corresponding to the time delay set by means of device 98, commencing with the deactivation of heat pump 22 and blower 47, control apparatus 50 ignores the electrical signal from current sensor 58 indicating electric current flow to heating element 14, such that heating element 14 is operable to continue heating water in tank 12 after heat pump 22 and blower 47 are deactivated. During the third predetermined period, heating element 14 is used to "boost" the temperature of water in tank 12 to the desired temperature (as indicated by the set temperature of thermostat 16) when the demand for water heating has not been fully satisfied by heat pump 22. As previously indicated, heating element 14 will only be operated if thermostat 16 is set at a higher temperature than the set temperature of temperature sensor 54. If at any time during the control routine, electrical power supplied on conductor 60 (FIG. 2) is discontinued, the control routine will be in a "power off" condition. When electrical power is returned, the control routine will begin anew, as described hereinabove.

In accordance with the present invention, an external heat source such as a heat pump is used as a primary source of water heating in lieu of a conventional electrically resistive heating element. It is well-known that a heat pump water heater can be operated more efficiently than an electrically resistive heating element. A temperature sensor external to the water storage tank is used to control the operation of the heat pump. The external temperature sensor is used to disable the heat pump when the incoming water temperature reaches a predetermined level (e.g., 130° F.). The electrically resistive heating element under the control of the tank-mounted thermostat is used to "top off" the temperature of the water in the storage tank if the demand for water heating has not been fully satisfied by the external heat source.

In accordance with the present invention, the more efficient heat pump is used as the primary source of water heating and the electrically resistive heating element is used to boost the temperature of the water in the tank to the desired level if the desired water temperature is greater than the maximum allowable temperature of the water entering the heat pump because of the operating limitations of the heat pump. It is usually desirable to set the tankmounted thermostat at a lower temperature than the set temperature of the external temperature sensor which controls the heat pump so that the electrically resistive heating element is not used at all, thereby providing more efficient water heating than when an electrically resistive heating element is used.

Various embodiments of the invention have now been described in detail. Since it is obvious that changes in and additions to the above-described best mode embodiments may be made without departing from the nature, spirit and scope of the invention, the invention is not to be limited to the details set forth herein.

I claim:

1. In a water heating system having a water storage tank, an electrically resistive heating element located in the tank, an external heat source operatively connected with the tank and means for circulating water between the tank and the external heat source, apparatus for controlling the water heating system, said apparatus comprising:

an electric current sensor adapted to sense electric current flow to the heating element in response to a demand for heating and to provide a first electrical signal indicative thereof;

a temperature sensor adapted to be positioned external to the tank, to sense temperature of the water at a selected location external to the tank and to provide a second electrical signal indicative thereof; and control means for coordinately controlling the heating element and the external heat source, said control means being adapted to interrupt the electric current flow to the heating element to deactivate the heating element and to activate the external heat source to heat water circulated between the tank and the external heat source in response to said first electrical signal, said control means being further adapted to deactivate the external heat source in response to said second electrical signal indicating that the water temperature at said selected location has exceeded a predetermined temperature.

2. Apparatus of claim 1 wherein said control means is further operable for ignoring said first electrical signal in response to said second electrical signal indicating that the water temperature has exceeded said predetermined temperature, to allow electric current flow to the heating element.

3. Apparatus of claim 2 further including user-settable delay means for setting a predetermined time delay, said control means being operable for ignoring said first electrical signal for a predetermined period corresponding to said predetermined time delay, said predetermined period commencing when said second electrical signal indicates that the water temperature has exceeded said predetermined temperature.

4. Apparatus of claim 1 wherein said temperature sensor is adapted to sense the temperature of water entering the external heat source before the water is heated thereby.

5. In combination:

a water heater including a water storage tank, an electrically resistive heating element located in the tank, and a tank-mounted thermostat which closes in response to a demand for water heating to allow electric current to flow to the heating element and which opens when the demand for water heating has been satisfied to interrupt the electric current flow to the heating element;

an external heat source including means for circulating water between the tank and the external heat source, whereby water is heated by the external heat source and returned to the tank; and apparatus for controlling the water heater and external heat source, said apparatus comprising:

electric current sensing means for sensing electric current flow to the heating element and for providing a first electrical signal indicative thereof;

temperature sensing means external to the tank for sensing temperature of the water at a selected location external to the tank and for providing a second electrical signal indicative thereof; and control means for coordinately controlling the heating element and the external heat source, said control means being adapted to interrupt the electric current flow to the heating element to deactivate the heating element and to activate the external heat source to heat water circulated between the tank and the external heat source in response to said first electrical signal, said control means being adapted to deactivate the external heat source in response to said second electrical signal indicating that the water temperature at said selected location has exceeded a predetermined temperature.

6. The combination of claim 5 wherein said control means is operable for ignoring said first electrical signal in responds to said second electrical signal indicating that the water temperature has exceeded said predetermined temperature, to allow electric current flow to the heating element.

7. The combination of claim 6 further including user-settable delay means for setting a predetermined time delay, said control means being operable for ignoring said first electrical signal for a predetermined period corresponding to said predetermined time delay, said predetermined period commencing in response to said second electrical signal indicates that the water temperature has exceeded said predetermined temperature.

8. The combination of claim 5 wherein said temperature sensing means is adapted to sense the temperature of water entering the external heat source before the water is heated thereby.

9. The combination of claim 8 wherein the water entering the external heat source to be heated thereby is removed from a bottom part of the tank.

10. The combination of claim 5 wherein said external heat source includes a heat pump.

11. A method of controlling a water heater and an external heat source operatively connected with the water heater, the water heater including a water storage tank, an electrically resistive heating element located in the tank, and a tank-mounted thermostat which closes in response to a demand for water heating to allow electric current to flow to a heating element and which opens when the demand for water heating has been satisfied to interrupt the electric current flow to the heating element, the external heat source including means for circulating water between the tank and the external heat source, whereby water is heated by the external heat source and returned to the tank, said method comprising the steps of:

sensing the electric current flow to the heating element and providing a first electrical signal indicative thereof;

sensing the temperature of the water at a selected location external to the tank and providing a second electrical signal indicative thereof;

interrupting the electric current flow to the heating element to deactivate the heating element and activating the external heat source in response to said first electrical signal, water circulated between the tank and external heat source being heated by external heat source; and deactivating the external heat source in response to said second electrical signal indicating that the water temperature has exceeded a predetermined temperature.

12. The method of claim 11 further including ignoring said first electrical signal in response to said second electrical signal indicating that the water temperature has exceeded said predetermined temperature, to allow electric current flow to the heating element.

13. The method of claim 12 further including setting a predetermined time delay, said ignoring including ignoring said first electrical signal for a predetermined period corresponding to said predetermined time delay, said predetermined period commencing in response to said second electrical signal indicating that the water temperature has exceeded said predetermined temperature, thereby allowing electric current flow to the heating element during said predetermined period.

14. The method of claim 11 wherein said sensing the temperature of the water includes sensing the temperature of the water entering the external heat source before the water is heated thereby.

15. A method of heating water, comprising the steps of:

providing a water storage tank, an electrically resistive heating element located in the tank, and a tank-mounted thermostat which closes in response to a demand for water heating to allow electric current to flow to the heating element and which opens when the demand for water heating has been satisfied to interrupt the electric current flow to the heating element;

providing an external heat source;

sensing the electric current flow to the heating element in response to the closure of the thermostat and providing a first electrical signal indicative thereof;

interrupting the electric current flow to the heating element in response to said first electrical signal to deactivate the heating element;

activating the external heat source in response to said first electrical signal;

circulating water between the tank and the external heat source, whereby water is heated by the external heat source and returned to the tank;

sensing the temperature of the water at a selected location external to the tank and providing a second electrical signal indicative thereof; and deactivating the external heat source in response to said second electrical signal indicating that the water temperature has exceeded a predetermined temperature.

16. The method of claim 15 further including ignoring said first electrical signal in response to said second electrical signal indicating that the water temperature has exceeded said predetermined temperature, to allow electric current flow to the heating element.

17. The method of claim 16 further including setting a predetermined time delay, said ignoring including ignoring said first electrical signal for a predetermined period corresponding to said predetermined time delay in response to said second electrical signal indicating that the water temperature has exceeded said predetermined temperature, thereby allowing electric current flow to the heating element during said predetermined period.

18. The method of claim 15 wherein said sensing the temperature of the water includes sensing the temperature of the water entering the external heat source before the water is heated thereby.

19. The method of claim 15 wherein said circulating includes drawing water to be heated from a bottom part of the tank, transporting said water to said external heat source for heating and returning the heated water to the bottom part of the tank for storage.

* * * * *